United States Patent [19]

Vuillaume et al.

[11] Patent Number: 4,699,060

[45] Date of Patent: Oct. 13, 1987

[54] DETONATION ARRESTOR DEVICE FOR BULK EXPLOSIVE MATERIALS TRANSFER

[75] Inventors: Pierre Vuillaume, Pont-Sainte-Maxence; Didier Gaston, Verneuil-en-Halatte, both of France

[73] Assignee: Charbonnages de France, Paris, France

[21] Appl. No.: 876,208

[22] Filed: Jun. 18, 1986

[30] Foreign Application Priority Data

Jun. 26, 1985 [FR] France ..... 85 09719

[51] Int. Cl.[4] ..... F42D 3/00

[52] U.S. Cl. ..... 102/313; 102/312; 86/20.15; 269/3.4

[58] Field of Search ..... 264/3.1–3.6; 102/312, 313; 86/20.15

[56] References Cited

U.S. PATENT DOCUMENTS

| | | | |
|---|---|---|---|
| 2,903,969 | 9/1959 | Kolbe | 102/23 |
| 3,040,615 | 6/1962 | Johansson et al. | 102/313 X |
| 3,064,572 | 11/1962 | Aitchison | 102/313 X |
| 3,713,360 | 1/1973 | Shansey | 86/1 |
| 4,074,629 | 2/1978 | Colgate | 102/313 X |
| 4,098,189 | 7/1978 | Holm | 264/3.1 X |
| 4,102,240 | 7/1978 | Cook et al. | 86/20.13 |
| 4,142,928 | 3/1979 | Stewart | 264/3.1 X |
| 4,522,125 | 6/1985 | Marz | 102/313 |
| 4,526,633 | 7/1985 | Lawrence et al. | 264/3.1 X |

FOREIGN PATENT DOCUMENTS

| | | | |
|---|---|---|---|
| 652324 | 12/1977 | U.S.S.R. | 86/20.13 |

OTHER PUBLICATIONS

Industrial and Engineering Chemistry: Industrial Section, vol. 60, No. 7, Jul. 1968, pp. 44–55; M. A. Cook: "Explosives–A Survey of Technical Advances".

*Primary Examiner*—Peter A. Nelson
*Attorney, Agent, or Firm*—Browdy and Neimark

[57] ABSTRACT

A system for transferring bulk explosive materials comprises at least one bulk explosive material storage tank and a transfer hose connected to this tank. The hose is used to fill a receptacle, typically a borehole in a mine, with explosive material, at least in part. A detonation arrestor device comprises a central channel in the hose adapted to have the explosive materials pass along its outside and fumes to pass along its inside in the event of an unintentional explosion.

9 Claims, 6 Drawing Figures

DETONATION ARRESTOR DEVICE FOR BULK EXPLOSIVE MATERIALS TRANSFER

BACKGROUND OF THE INVENTION

1. Field of the Invention

The present invention concerns a detonation arrestor device for bulk explosive materials transfer.

2. Description of the Prior Art

The presence of a detonator at the bottom of a borehole during bulk explosive transfer increases the risk of unintentional explosion. To limit the consequences of any such explosion following electrical disturbances (storms, etc) for example, it is important that any detonation started in the borehole (which can contain as much as several hundred kilograms of explosive in the case of open cast mining) cannot propagate through the loading hose as far as the stock of bulk explosive, generally consisting of one or more storage tanks, the total quantity of which on the same site may be several tons, explosion of which could have catastrophic consequences.

Given the high detonation velocity in a cylindrical charge of explosive (several kilometers per second) and the destructive effects of the shockwave due to the detonation, implementing a detonation arrestor system by simple mechanical means is no simple matter.

The solution currently adopted for limiting the risk of detonation propagating through the loading hose consists in limiting the diameter of the hose to a value below the critical detonation diameter of the pumped explosive. The critical detonation diameter of an explosive is a value of the diameter of a cylindrical charge of that explosive below which detonation is incapable of propagating through the charge.

This solution has been adopted in French regulations governing the pumping of explosives in mines and quarries: with a detonator at the bottom of the borehole, the diameter of the hose for loading explosive by pumping must be limited to 25 mm, a value which is in theory below the critical detonation diameters of all explosives loading of which by pumping is authorized in France.

Limiting the diameter of the hoses to 25 mm significantly reduces the pumping rate and commensurately increases the loading time. This increases the time for which personnel are exposed to explosive hazards and may even call into question the economic advantages of bulk transfer of explosives by pumping, especially in the case of blasting deep vertical open cast mines with the explosion initiated from the bottom of the borehole.

In the case of explosives that can be pumped, which are slurry and emulsion explosives, for example, the choice of the critical detonation diameter as the criterion for limiting the hose diameter is disputable: the value of the critical detonation diameter is an intrinsic characteristic of any given explosive and is determined under specific experimental conditions (lightly filled cartridge, standardized density, etc); this is generally done "once and for all" when the product is being examined for approval. It is not certain that this characteristic is representative of the explosive under normal utilization conditions.

Specifically, the confinement due to the reinforced rubber of the loading hoses may slightly reduce the value of the critical detonation diameter. This parameter may also depend closely on the density of the explosive under its conditions of utilization, however. The density of pumpable explosives may vary significantly with:

the pressure to which the product is subjected in the hose during pumping, this effect being generally in the direction of increased safety, with pressures of the order of a few bars as routinely obtained at pump outlets being sufficient to desensitize the explosives, commercial imperatives which require manufacturers to regulate the density of their product, which is done by mechanical means (stirring to procure aeration) or chemical means (variation in the quantity of lightening or emulsifying agent).

In the final analysis, the current rule limiting the diameter of pumping hoses not only has major disadvantages from the point of view of practical pumping conditions, but also fails in certain cases to prevent propagation of detonation from the bottom of the borehole to the explosive materials storage tanks.

To alleviate these disadvantages, whilst tolerating fluctuations in the critical diameter of the explosive materials transferred and without affecting the transfer rate, an object of the invention is to arrest detonation between an explosive materials transfer system and a storage tank of the explosive materials.

SUMMARY OF THE INVENTION

In a system for transferring bulk explosive materials comprising at least one bulk explosive materials storage tank and a transfer hose connected to said at least one storage tank and adapted to fill a receptacle at least partly with said explosive materials, the present invention consists in a detonation arrestor device comprising a central channel in said hose adapted to have said explosive material pass along its outside and fumes to pass along its inside in the event of unintentional explosion.

The characteristics and advantages of the invention will emerge from the following description given by way of non-limiting example only and with reference to the appended drawings.

DESCRIPTION OF THE PREFERRED EMBODIMENT

Figure 1:
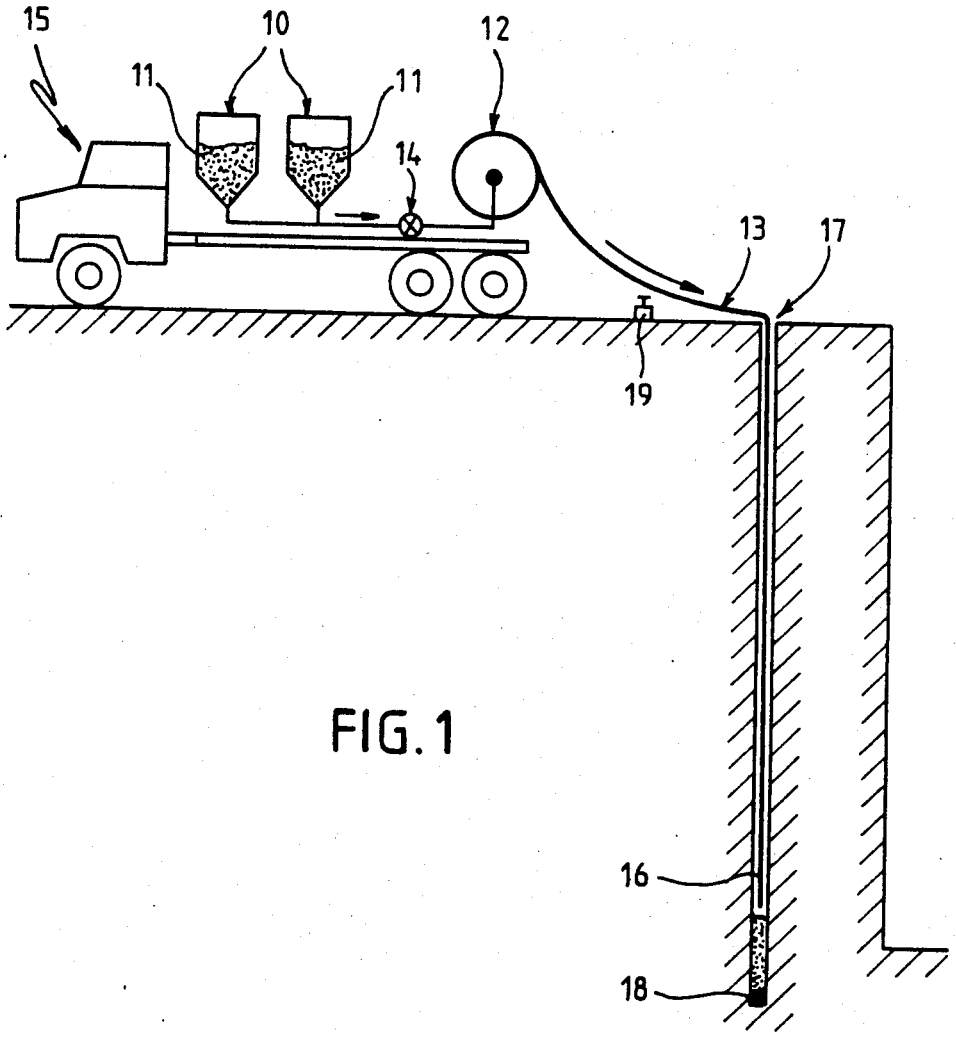
FIG. 1 shows a prior art device as used in open cast mining.

The selected embodiment of the known prior art device shown in FIG. 1 comprises two storage tanks 10 containing a certain quantity of explosive 11, a hose 13 leading from these storage tanks, a winder 12 for the hose 13 and a pump 14, all disposed on a truck 15.

In the remainder of this description the expression "pumping" corresponds to discharge of the explosive by the pump through the hose 13.

The free end 16 of the hose 13 decends into a vertical borehole 17 at the bottom of which a detonator 18 has previously been placed.

A triggering device 19 at the surface is connected to the detonator 18 by any known means.

When loading is begun the end of the hose is at the bottom of the borehole 17 and is subsequently gradually raised, for example by progressively rewinding the hose 13 onto the winder 12, so that it always remains in contact with the surface of the explosive poured into the borehole.

In normal operation, once the bulk explosive has been pumped into part of the borehole the explosion is remotely initiated using the triggering device 19.

However, during the loading of the borehole the presence of the detonator 18 at the bottom of the borehole 17 increases the risk of accidental explosion due, for example, to mechanical shock or electrical disturbances.

The known prior art solution for limiting these risks consisting in limiting the diameter of the hose to a value below a threshold corresponding to the critical detonation diameter of the explosive being pumped.

Figure 2:
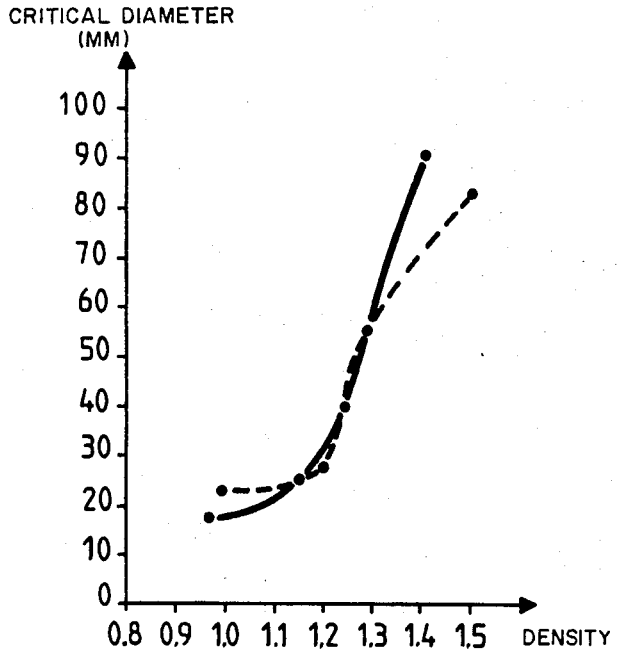
FIGS. 2 and 3 are characteristic curves for two specified explosives.

FIG. 2 shows curves plotting the variation in this critical detonation diameter as a function of density under normal pressure for two pumpable slurry type explosives.

Figure 3:
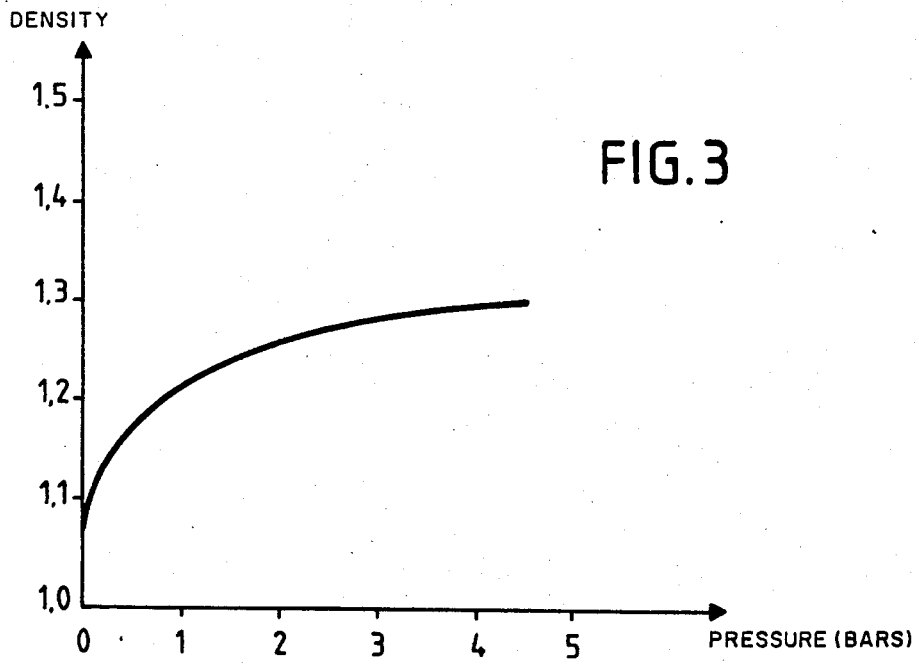

FIG. 3 is a curve showing the variation of density as a function of pressure for one of these slurries.

The device in accordance with the invention makes it possible to arrest detonation before it reaches the stock of explosive in the event of accidental explosion. This device tolerates fluctuations in the critical diameter of the explosive being pumped and does not affect the pumping rate.

Figure 4:
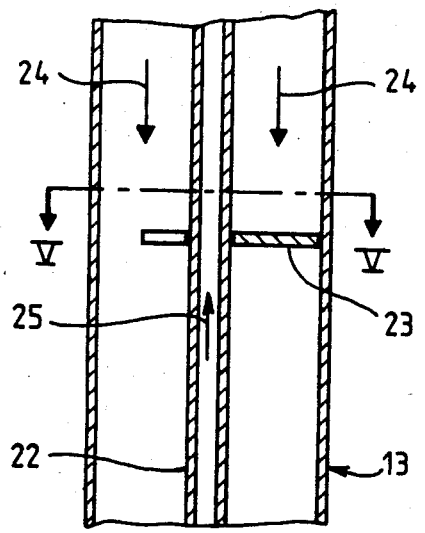
FIG. 4 is a view of the device in accordance with the invention in longitudinal cross-section.
Figure 5:
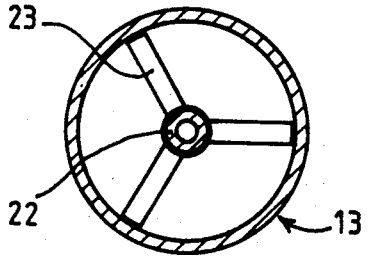
FIG. 5 is a view of the device shown in FIG. 4 in transverse cross-section on the line V—V.

In the embodiment shown in FIGS. 4 and 5, the device in accordance with the invention comprises a central channel 22 disposed concentrically within the hose 13 over at least part of its length. This channel is held in place by centering rings 23.

The device in accordance with the invention exploits the so-called "channel effect" phenomenon: when a charge detonates in a confined space and an open space of small size is provided in the charge or between the charge and whatever is confining it, then the fumes produced by decomposition of the explosive can reach a speed higher than the detonation velocity of the explosive. The fumes then propagate along this empty space in advance of the detonation front. Their pressure is sufficient to desensitize the explosive by compressing it, so arresting the detonation.

On FIG. 4 are shown the direction 24 in which the explosive flows and the direction 25 in which the fumes propagate in the case of accidental explosion in the borehole, the hose being still disposed in the borehole.

Figure 6:
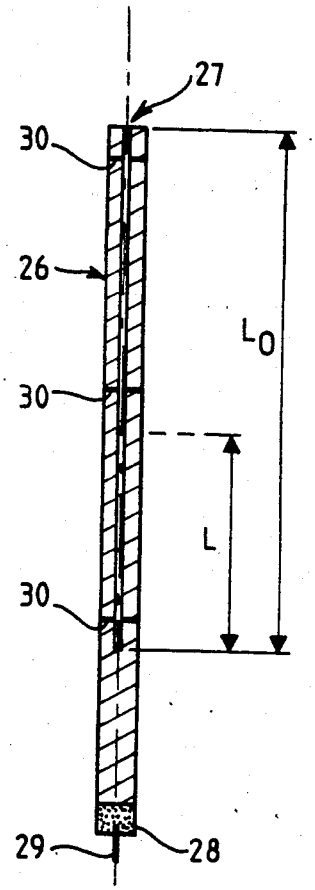
FIG. 6 shows a device used in experimental development of the invention.

Detonation propagation tests using experimental devices with the structure shown in FIG. 6 have been conducted using the two aforementioned pumpable explosives.

In these devices the fumes channel is central, along the axis of the charge. The devices comprise:

an outer tube 26 of polyvinyl chloride or "PVC" with inside and outside diameters of 53 and 63 mm and a length of 1 100 mm and a "PVC" tube central channel 27 with inside and outside diameters of 8 and 10 mm and a length of 850 mm, centered by means of a number of iron wire rings 30;

an outside tube 26 of "PVC" having inside and outside diameters of 75 and 80 mm and a length of 1 100 mm with a "PVC" tube central channel 27 having inside and outside diameters of 8 and 10 mm and a length of 850 mm centered by means of a number of iron wire rings 30.

The objective of the differences between the lengths of the outer tube 26 and central channel 27 is to provide a length of 250 mm to permit detonation to reach steady-state conditions.

The explosives filling the annular space between the central channel 27 and the outer tube 26 is detonated by means of a detonator 28 and a plastics explosives booster 29. Possible propagation of detonation is monitored by:

marking of lead plates;

resistive probe 850 mm long at the end of the device;

verification that a length of detonator cord at the end of the charge has not been detonated.

The results are summarized in table 1 at the end of this description, which shows:

the number of detonations observed for the number of tests conducted;

the ratio of the propagation length L to the total length Lo of the central channel 27, these lengths being measured from the origin of the central channel.

In all cases detonation terminated before reaching the end of the test device, the length over which it propagates increasing when the inside diameter of the outside tube is increased or when the critical detonation diameter of the explosive is reduced.

In the tests the diameter of the central channel was 10% or 15% of the diameter of the charge. Values of this order would seem optimal for the device in accordance with the invention.

The material of which the outer tube is made matters little provided that it is able to resist the pumping pressure; on the other hand, the inner tube must be sufficiently strong to resist pressures of a few bars produced by pumping, but also sufficiently deformable or friable to permit the fumes to act on the explosive.

The minimal length of the channel needed to be sure that detonation is arrested for proportional to the diameter of the outer tube for a central channel of given diameter. For an outer tube diameter of 75 mm with a 10 mm inner channel, which should not be prejudicial to the pumping rates, a minimum length of approximately 2 m, that is a length more than 25 times the inside dimater of the hose, would guarantee an extremely acceptable level of safety since tests have been conclusive with a length of 0.85 m. In practise an inner channel of this kind is advantageously disposed over all the length of the hose on the output side of the pump, which may lead to providing within the hose a flexible hollow core several tens of meters long.

The invention is obviously not limited to the details of the embodiment that have just been described by way of example.

The borehole may be a receptacle of any shape.

The device in accordance with the invention may be installed on any bulk explosive materials transfer system.

A localized device may be mounted, for example:

at the end of the hose adapted to be lowered into a borehole 17; or between the winder 12 and the storage tanks 10, in which case a screen would have to be positioned between the winder and the storage tanks to protect the latter from sparks resulting from an explosion within the winder.

TABLE 1 :

| DETONATION ARRESTOR DEVICE TEST RESULTS | | | | | | |
|---|---|---|---|---|---|---|
| | | | CHANNEL EFFECT | | | |
| | | CRITICAL | 53/10 | | 75/10 | |
| EXPLOSIVE | DENSITY | DIAMETER | RESULT | $L/L_0$ | RESULT | $L/L_0$ |
| No 1 | 1.19 | 45 | 0/1 | 0.34 | 0/1 | 0.74 |
| No 2 | 1.17 | 25 | 0/1 | 0.76 | 0/1 | 0.85 |
| No 2 | 1.29 | 55 | 0/1 | 0.47 | 0/1 | 0.74 |
| No 2 | 1.33 | 70 | 0/1 | 0.08 | 0/1 | 0.27 |

There is claimed:

1. In a system for transferring bulk explosive materials, comprising at least one bulk explosive materials storage tank and a temporarily inserted transfer loading hose connected to said at least one storage tank and adapted to fill a receptacle at least partly with said explosive materials, a detonation arrestor device comprising a central channel in said hose deferring an annular flow section for explosive material flowing down said hose and permanently providing within the downwardly flowing explosive material an elongated empty space for allowing, in case of unintentional explosion, resulting fumes to propagate within the flowing explosive material in advance of a detonation front resulting from said explosion.

2. Device according to claim 1, wherein said central channel has an inside diameter greater than 10% of the inside diameter of said hose.

3. Device accordang to claim 1, wherein said central channel has an inside diameter less than 15% of the inside diameter of said hose.

4. Device according to claim 1, wherein said central channel has a length more than 25 times the inside diameter of said hose.

5. Device accordaing to claim 1, further comprising centering rings whereby said central channel is supported in said hose.

6. Device according to claim 1, wherein said central channel is disposed in said hose between said storage tank in which said explosive materials are stored and said receptacle.

7. Device according to claim 1, wherein said hose comprises two parts one on each side of a winder on which said hose is stored and said central channel is disposed in said hose between said winder and said receptacle.

8. Device according to claim 1, wherein said hose comprises two parts one on each side of a winder on which said hose is stored and said central channel is disposed in said hose between said winder and said storage tank in which said explosive materials are stored, said device further comprising a screen disposed between said winder and said storage tank.

9. In a system for transferring bulk explosive materials, comprising at least one bulk explosive materials storage tank and a temporarily inserted transfer loading hose connected to said at least one storage tank and adapted to fill a borehole at least partly with said explosive materials, a detonation arrestor device comprising a central channel in said hose deferring an annular flow section for explosive material flowing down said hose and permanently providing within the downwardly flowing explosive material an elongated empty space for allowing, in case of unintentional explosion, resulting fumes to propagate within the flowing explosive material in advance of a detonation front resulting from said explosion.

* * * * *